US005374048A

United States Patent [19]

Takahashi

[11] Patent Number: 5,374,048

[45] Date of Patent: Dec. 20, 1994

[54] CYLINDRICAL PRESS MEMBER WITH AN OUTER SURFACE HAVING VARYING FRICTIONAL CHARACTERISTICS

[75] Inventor: Yasuhiro Takahashi, Minato, Japan

[73] Assignee: Riso Kagaku Corporation, Tokyo, Japan

[21] Appl. No.: 913,351

[22] Filed: Jul. 15, 1992

[30] Foreign Application Priority Data

Jul. 29, 1991 [JP] Japan ..... 3-211578

[51] Int. Cl.[5] ..... B65H 3/52

[52] U.S. Cl. ..... 271/121; 271/125

[58] Field of Search ..... 271/121, 124, 125, 126, 271/127, 167

[56] References Cited

U.S. PATENT DOCUMENTS

| | | | |
|---|---|---|---|
| 4,313,598 | 2/1982 | DiBlasio | 271/124 |
| 4,529,187 | 7/1985 | Einem et al. | 271/121 |
| 4,858,907 | 8/1989 | Eisner et al. | 271/124 |
| 4,978,115 | 12/1990 | Sato et al. | 271/124 |
| 4,991,831 | 2/1991 | Green | 271/121 |
| 5,102,115 | 4/1992 | Takamizawa et al. | 271/124 |
| 5,104,113 | 4/1992 | Kameyama et al. | 271/124 |
| 5,273,269 | 12/1993 | Iwanaga | 271/124 |

FOREIGN PATENT DOCUMENTS

| | | | |
|---|---|---|---|
| 178130 | 3/1990 | Japan | 271/121 |
| 62335 | 7/1990 | Japan | 271/121 |
| 2029377 | 3/1980 | United Kingdom | 271/124 |
| 2142321 | 1/1985 | United Kingdom . | |

*Primary Examiner*—David H. Bollinger

*Attorney, Agent, or Firm*—Stevens, Davis, Miller & Mosher

[57] ABSTRACT

A device for transferring paper sheets one by one successively in separation, having, as viewed in FIG. 1, a paper sheet feed roller 1 adapted to be driven for rotation, and a press member 3 disposed to oppose a cylindrical outer surface of the paper sheet feed roller along a generatrix thereof so as to define a nip region 2 therebetween for nipping the paper sheet therein, wherein a friction coefficient between the outer surface of the paper sheet feed roller and the upper surface of the paper sheet contacting therewith is higher than a friction coefficient between the upper surface and the lower surface of the paper sheet, and the press member is shiftable relative to the paper sheet feed roller so as thereby to change a mean friction coefficient between a band surface area thereof opposing the paper sheet feed roller in the nip region and the lower surface of the paper sheet contacting therewith within a range lower than the friction coefficient between the outer surface of the paper sheet feed roller and the upper surface of the paper sheet but higher than the friction coefficient between the upper and lower surfaces of the paper sheet.

5 Claims, 1 Drawing Sheet

CYLINDRICAL PRESS MEMBER WITH AN OUTER SURFACE HAVING VARYING FRICTIONAL CHARACTERISTICS

BACKGROUND OF THE INVENTION

1. Field of the Invention

The present invention relates to a device for transferring paper sheets in a printing device, a copying device, etc., and more particularly, to a paper sheet transfer device having a paper sheet separating function so as to transfer paper sheets one by one successively in separation.

1. Description of the Prior Art

It is conventionally know to incorporate such a paper sheet transfer device having a paper sheet separating function in a printing device, a copying device, etc., so as to transfer paper sheets one by one successively in separation, that comprises a paper sheet feed roller adapted to be driven for rotation, and a press member disposed to oppose a cylindrical outer surface of the paper sheet feed roller along a generatrix thereof so as to define a nip region therebetween for nipping a paper sheet therein, wherein the friction coefficient between the outer surface of the paper sheet feed roller and a first surface of the paper sheet to contact therewith is higher than a friction coefficient between the first surface of the paper sheet and a second surface of the paper sheet opposite to the first surface, and the friction coefficient between a band surface area of the press member opposing the paper sheet feed roller in the nip region and the second surface of the paper sheet is lower than the friction coefficient between the outer surface of the paper sheet feed roller and the first surface of the paper sheet but higher than the friction coefficient between the first and second surfaces of the paper sheet, so that, when the paper sheet feed roller is driven for rotation, the paper sheets fed to the nip region is transferred through the nip region one by one successively in separation.

The paper sheet transfer device of the above-mentioned construction can be operated in such a manner that the paper sheets are transferred one by one successively in separation generally without fail, when the friction coefficient between the outer surface of the paper sheet feed roller and the first surface of the paper sheet and the friction coefficient between the band surface area of the press member and the second surface of the paper sheet are properly determined in relation to the friction coefficient between the first and second surfaces of the paper sheet.

However, when the friction characteristic of the first surface and/or the second surface of the paper sheet varies according to changes of the kinds of the paper sheets to be processed, the conventional paper sheet transfer device of this type is put into such troubles that the separation of the paper sheets becomes insufficient or the transfer of the paper sheets becomes insufficient. In more detail, when the friction coefficient between the first and second surfaces of the paper sheet becomes higher than an expected design value, the separation of the paper sheets becomes insufficient so that two or more paper sheets are often transferred together through the nip region as overlapped one over another. This is due to the insufficiency of the friction coefficient between the press member and the second surface of the paper sheet relative to the friction coefficient between the first and second surfaces of the paper sheet. On the other hand, when the friction coefficient between the first and second surfaces of the paper sheet becomes lower than an expected design value, although no malfunction occurs with respect to the separation of the paper sheets, if the decrease of the friction coefficient between the first and second surfaces of the paper sheet is due to a decrease of the friction characteristic of at least the first surface of the paper sheet, the transfer of the paper sheets becomes uncertain.

SUMMARY OF THE INVENTION

In view of the above-mentioned problems in the conventional paper sheet transfer device having a paper sheet separating function of the above-mentioned type, it is therefore a primary object of the present invention to provide an improved paper sheet transfer device having a paper sheet separating function so as to transfer paper sheets with no failure and with definite separation of the paper sheets, regardless of changes of the friction characteristic of the surfaces of the paper sheets according to changes of the kinds of the paper sheets processed.

Further, in relation to the above-mentioned object, in consideration of the fact that there is such an incompatibility between the conditions for improving the transfer of paper sheets and the conditions for improving the separation of the paper sheets that, when the friction coefficient between the press member and the second surface of the paper sheet is increased, the paper sheet separation is improved but the transfer of the paper sheets is deteriorated, while, when the friction coefficient between the press member and the second surface of the paper sheet is decreased, the transfer of the paper sheets is improved but the paper sheet separation is deteriorated, it is a further object of the present invention to improve the paper sheet transfer device having a paper sheet separating function so that both the paper sheet separation performance and the paper sheet transfer performance are improved.

According to the present invention, the above-mentioned primary object is accomplished by a device for transferring paper sheets one by one successively in separation, comprising a paper sheet feed roller adapted to be driven for rotation, and a press member disposed to oppose a cylindrical outer surface of said paper sheet feed roller along a generatrix thereof so as to define a nip region therebetween for nipping the paper sheet therein, wherein a friction coefficient between the outer surface of said paper sheet feed roller and a first surface of the paper sheet contacting therewith is higher than a friction coefficient between the first surface and a second surface opposite to the first surface of the paper sheet, and said press member is shiftable relative to said paper sheet feed roller so as thereby to change a mean friction coefficient between a band surface area thereof opposing said paper sheet feed roller in said nip region and the second surface of the paper sheet contacting therewith within a range lower than the friction coefficient between the outer surface of said paper sheet feed roller and the first surface of the paper sheet but higher than the friction coefficient between the first and second surfaces of the paper sheet.

Further, according to the present invention, the above-mentioned further object is accomplished by the above-mentioned paper sheet transfer device which accomplishes the primary object, wherein said press member is constructed to increase the mean friction coefficient between the band surface area thereof and the second surface of the paper sheet in said nip region as said press member is shifted relative to said paper sheet feed roller so that a more downstream band surface area thereof as viewed in a direction of the paper sheet transfer is brought to said nip region.

When the press member is so constructed as mentioned above, so that the mean friction coefficient between the band surface area thereof opposing the paper sheet feed roller in the nip region is changed within the range lower than the friction coefficient between the outer surface of the paper sheet feed roller and the first surface of the paper sheet but higher than the friction coefficient between the first and second surfaces of the paper sheet according to the changes of the position thereof relative to the paper sheet feed roller, the mean friction coefficient between the band surface area of the press member and the second surface of the paper sheet can be changed to match with the friction characteristic of the surfaces of the paper sheet processed, so that when the friction characteristic of the surfaces of the paper sheet is relatively low, the mean friction coefficient between the band surface area of the press member and the second surface of the paper sheet is changed to be correspondingly relatively low, while, when the friction characteristic of the surfaces of the paper sheet is relatively high, the mean friction coefficient between the band surface area of the press member and the second surface of the paper sheet is changed to be correspondingly relatively high, thereby accomplishing the transfer of the paper sheets at high certainty while separating the paper sheets at high certainty, regardless of the kinds of the paper sheets processed.

Further, by the press member being so constructed that this mean friction coefficient between the band surface area of the press member and the second surface of the paper sheet in the nip region increases as the press member is so shifted relative to the paper sheet feed roller that a more downstream band surface area thereof as viewed in a direction of the paper sheet transfer is brought to the nip region, when two paper sheets proceed to the nip region as overlapped one over the other, they are nipped between the paper sheet feed roller and the press member with the first surface of a paper sheet on the side of the paper sheet feed roller and the second surface of a paper sheet on the side of the press member being brought into contact with the paper sheet feed roller and the press member, respectively, and as they proceed through the nip region, a difference between the friction force acting from the press member to the paper sheet on the side of the press member and the friction force acting from the paper sheet on the side of the press member to the paper sheet on the side of the press member increases, and therefore, when the distribution of the friction characteristic of the press member is so determined that the gradient of the increase of said difference between the friction forces is proper, the progress of the paper sheet on the side of the press member stops at a middle position of the nip region, and therefore, the paper sheet on the side of the paper sheet feed roller is finally transferred in such a state that the contact of the second surface thereof with the press member having a friction characteristic higher than the paper sheet is partly replaced by the contact with the paper sheet having a lower friction characteristic and positioned thereunder as partly nipped into the nip region, so that the separation of the paper sheets is definitely effected, while the tensile stress acting in the paper sheet during the transfer is correspondingly decreased, thereby accomplishing a light and positive paper sheet transfer.

BRIEF DESCRIPTION OF THE DRAWING

In the accompanying drawing,

FIGS. 2A and 2B are views showing an embodiment of the press member in the paper sheet transfer device having a paper sheet separating function according to the present invention, wherein FIG. 2A is a perspective view, and FIG. 2B is a development view of the cylindrical outer surface of the cylindrical press member shown in FIG. 2A;

DESCRIPTION OF THE PREFERRED EMBODIMENTS

In the following the present invention will be described in detail with respect to some preferred embodiments thereof with reference to the accompanying drawing.

Figure 1:
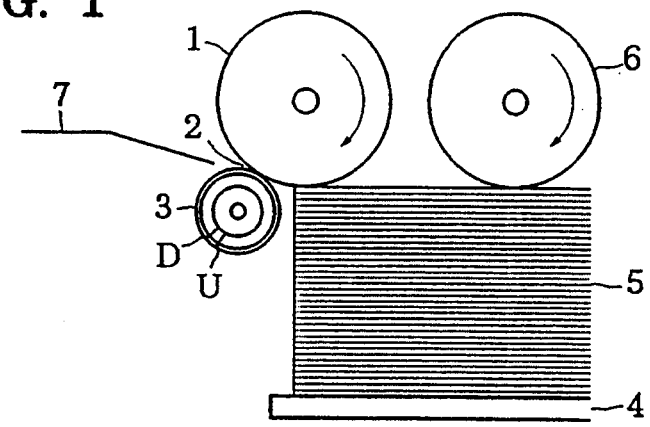
FIG. 1 is a somewhat diagrammatical side view showing an embodiment of the paper sheet transfer device having a paper sheet separating function according to the present invention.

Referring to FIG. 1 showing in a somewhat diagrammatical fashion a side view of an embodiment of the paper sheet transfer device having a paper sheet separating function according to the present invention constructed as a paper sheet transfer device for feeding paper sheets one by one as taken out from a stack of paper sheets in a printing device or the like, a paper sheet feed roller 1 is adapted to be driven for rotation in the rotational direction shown by an arrow by a driving means not showing in the figure when a paper sheet is to be fed. As opposing the paper sheet feed roller 1, a press member 3 is provided so as to define a nip region 2 for nipping the paper sheet therein along a generatrix of the cylindrical configuration of the paper sheet feed roller 1. In the embodiment shown in FIG. 1, the press member 3 has a cylindrical shape as described hereinunder with reference to FIGS. 2A and 2B and FIGS. 3A and 3B. The paper sheet feed roller 1 is positioned to contact the upper surface of an uppermost paper sheet of a stack body 5 of paper sheets placed on a paper sheet supply table 4.

As arranged in parallel with the paper sheet feed roller 1, a scraper roller 6 is provided so as also to contact the upper surface of the uppermost paper sheet of the stack body 5 of paper sheets. The scraper roller 6 is also adapted to be selectively driven for rotation in the rotational direction shown by an arrow by a driving means not shown in the figure, so as to transfer the uppermost paper sheet toward the nip region 2, together with the paper sheet feed roller 1.

Each paper sheet, when its leading end was fed into the nip region 2, is transferred leftward in the figure through the nip region 2 along with the rotation of the paper sheet feed roller 1, to be further guided by a paper sheet guide 7 toward a printing position.

The paper sheet feed roller 1 (also the scraper roller 6) is so constructed that the friction coefficient between the outer surface thereof and the upper surface of the paper sheet is higher than the friction coefficient between the upper surface and the lower surface of the paper sheet, so that, when the paper sheet feed roller 1 and the scraper roller 6 are rotated, the paper sheets of the stack body 5 are successively transferred toward the nip region 2, starting from the uppermost paper sheet. At this time, due to the friction between the paper sheets, the paper sheet just below the paper sheet which is in contact with the paper sheet feed roller 1 and the scraper roller 6 is generally transferred to follow the upper paper sheet toward the nip region 2. However, since the mean friction coefficient between a band surface area of the press member 3 opposing the paper sheet feed roller 1 in the nip region 2 and the lower surface of the paper sheet is higher than the friction coefficient between the upper and lower surfaces of the paper sheet, while, since said mean friction coefficient is lower than the friction coefficient between the outer surface of the paper sheet feed roller 1 and the upper surface of the paper sheet, the lower paper sheet which has entered into the nip region 2 following the upper paper sheet is stopped from proceeding further by a contact with the press member, so that only the upper paper sheet is transferred along with the rotation of the paper sheet feed roller 1 through the nip region 2 toward the paper sheet guide means 7.

Figure 2A:
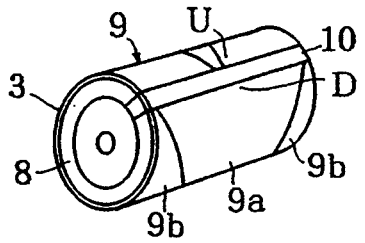
Figure 2B:
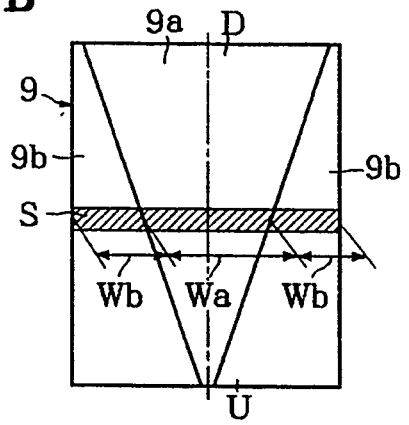

FIG. 2A is a somewhat diagrammatical perspective view showing an embodiment of the press member 3 in the paper sheet transfer device having a paper sheet separating function according to the present invention, while FIG. 2B is a development view showing the surface of the press member shown in FIG. 2A as developed to a plane. The press member of this embodiment comprises a cylindrical support body 8 and a sheet material 9 mounted around the cylindrical outer surface of the cylindrical support body 8. 10 designates a mounting member which fixes a leading end and a trailing end of the sheet material 9 to the cylindrical support body 8. As is better shown in FIG. 2B, the sheet material 9 which presents a rectangular shape defined by opposite lateral edges corresponding to a generatrix of the cylindrical press member 3 and opposite longitudinal edges corresponding to opposite circular edges of the cylindrical press member comprises triangular portions **9*a* and 9*b* different from one another in the friction characteristic which, when it is higher, means that a higher friction coefficient is available in contact with a mating surface, so that, when the sheet material is formed into a cylindrical shape wrapped around the cylindrical support body 8, the mean friction characteristic of a band surface area along a generatrix of the cylindrical configuration of the sheet material changes gradually along the peripheral position thereof. In this embodiment, the friction characteristic of the portion 9*a* is higher than the friction characteristic of the portion 9*b*. Therefore, as viewed in the development shown in FIG. 2B, expressing the friction characteristic of the portion 9*a* by Fa, the friction characteristic of the portion 9*b* by Fb, and the width of the portions 9*a* and 9*b* along a generatrix of the cylindrical body by Wa and Wb, respectively, the mean friction characteristic of a band surface area S along a generatrix is $(Fa \times Wa + 2Fb \times Wb)/(Wa + 2Wb)$, which gradually increases from an upstream end U toward a downstream end D as viewed in the direction of transfer of the paper sheet. Therefore, when the press member shown in FIG. 2A is mounted in the same posture relative to the paper sheet feed roller 1 shown in FIG. 1, the mean friction coefficient between a band surface region of the press member 3 positioned in the nip region 2 and the paper sheet nipped in the nip region 2 increases gradually as the press member 3 is moved relative to the paper sheet feed roller 1 so that a band surface region located closer to the downstream end D is brought to the nip region 2, i.e., as the press member 3 is rotated in the clockwise direction about its central axis as viewed in FIG. 1**.

Therefore, the leading edge portion of the paper sheet passing through the nip region 2 is applied with a higher friction from the press member 3 as it proceeds further. Therefore, when two paper sheets have been brought to the nip region 2 as overlapped one over the other, so that the upper paper sheet contacts with the paper sheet feed roller 1 while the lower paper sheet contacts with the press member 3, as the leading edges of these overlapped paper sheets proceed in the nip region, the difference between the friction force applied to lower surface of the lower paper sheet from the press member 3 and the friction force applied to the upper surface of the lower paper sheet from the upper paper sheet increases. When the gradient of the increase of the mean friction characteristic of the press member 3 opposing the paper sheet feed roller 1 in the nip region 2 in the direction of paper sheet transfer is properly determined, the proceed of the leading edge of the lower paper sheet stops at a middle portion in the nip region, so that the upper paper sheet is supported at its lower surface partly via the lower paper sheet whose leading edge has been nipped into the nip region but is held there until the upper paper sheet has been transferred therethrough, whereby the frictional supporting of the lower surface of the upper paper sheet by the contact with the press member 3 during the transfer through the nip region 3 is partly replaced by the contact with the upper surface of the lower paper sheet having a lower friction characteristic than the press member 3. Thus, the tensile stress applied to the paper sheet during its transfer through the nip region is reduced, while ensuring the paper sheet separation at the nip region, thereby accomplishing a light and definitely separating paper sheet transfer, enabling both the paper sheet separation performance and the paper sheet transfer performance to be improved.

Figure 3A:
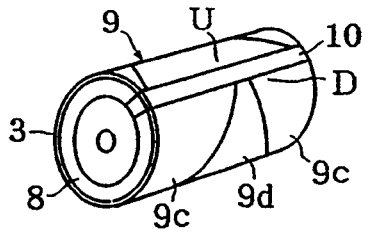
FIGS. 3A and 3B are views showing another embodiment of the press member in the paper sheet transfer device having a paper sheet separating function according to the present invention in the same manner of illustration as FIGS. 2A and 2B, including a perspective view and a development view.
Figure 3B:
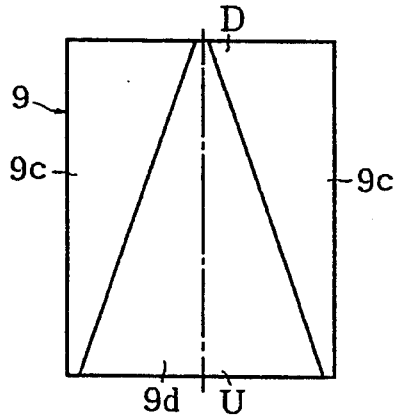

FIG. 3A is a perspective view showing another embodiment of the press member 3, and FIG. 3B is a development view of the cylindrical outer surface of the press member 3 shown in FIG. 3A, similar to FIGS. 2A and 2B, respectively. In this embodiment, the sheet material 9 has opposite side triangular portions **9*c* having a higher friction characteristic than a central triangular portion 9*d*, so that the mean friction characteristic of the press member 3 to oppose the paper sheet feed roller 1 in the nip region 2 also gradually increases from the end U toward the end D. Therefore, when the press member shown in FIG. 3A is mounted in the paper sheet transfer device having a paper sheet separating function shown in FIG. 1 in the same orientation, the mean friction coefficient between the band surface area of the press member 3 opposing the paper sheet feed roller 1 in the nip region 2 and the paper sheet nipped in the nip region increases as the press member 3** in the cylindrical configuration is rotated about its central axis in the clockwise direction as viewed in FIG. 1.

Figure 4:
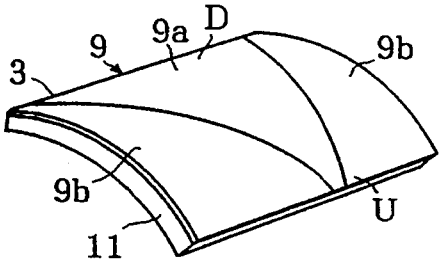
FIGS. 4 and 5 are perspective views showing two other embodiments of the press member in the paper sheet transfer device having a paper sheet separating function according to the present invention.
Figure 5:
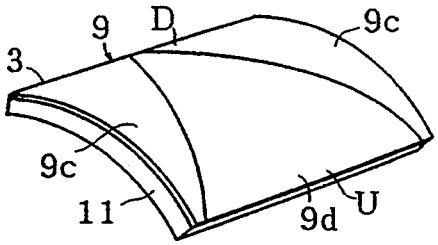

FIGS. 4 and 5 are perspective views showing other embodiments of the press member 3 which are constructed to have similar combinations of a triangular portion 9*a* having a high friction characteristic and a triangular portion 9*b* having a low friction characteristic or a triangular portion 9*c* having a high friction characteristic and a triangular portion 9*d* having a low friction characteristic like those shown in FIGS. 2A and 2B or FIGS. 3A and 3B, formed on an arc support body 11 which presents a convex paper sheet contact surface. Also in these embodiments, when the press member 3 is combined with the paper sheet feed roller 1 so that the front right end U as viewed in the perspective view, i.e. one edge parallel to a center axis of curvature of the arc support body 11, is positioned on the inlet side of the nip region 2 and the back left end D as viewed in the perspective view, i.e. another edge parallel to a center axis of curvature of the arc support body 11, is positioned on the exit side of the nip region 2, the mean friction coefficient between the band surface area of the press member 3 opposing the paper sheet feed roller 1 in the nip region 2 and the paper sheet nipped in the nip region 2 is adjustably changed according to shifting of the press member 3 relative to the paper sheet feed roller 1 so that the mean friction characteristic of the press member 3 opposing the paper sheet feed roller 1 in the nip region 2 increases in the direction of transfer of the paper sheet, and, as a portion closer to the downstream end D is brought to the nip region 2, the mean friction coefficient between the band surface area opposing the paper sheet feed roller 1 in the nip region 2 and the .paper sheet nipped in the nip region 2 increases.

The rotation adjustment of the press member 3 in the cylindrical shape shown in FIGS. 2A and 2B or FIGS. 3A and 3B around the central axis thereof or the adjustment of the arc shaped press member 3 shown in FIG. 4 or 5, preferably a turn adjustment thereof about the center axis of curvature thereof, so as to change the mean friction characteristic of the band surface area to oppose the paper sheet feed roller 1 in the nip region 2 may be automatically controlled to be optimum, in response to the designation of the paper quality or the kind of paper sheets made by a data input at a control panel of a printer, copying machine or the like. Alternatively, such an adjustment may be more automatically controlled by an automatic friction characteristic detection means which detects the friction characteristic of the paper sheet every time when a stack of paper sheets is loaded into the machine.

Although the present invention has been described in detail with respect to several preferred embodiments thereof, it will be apparent for those skilled in the art that various modifications are possible within the scope of the present invention.

I claim:

1. A device for transferring paper sheets one by one successively in separation, comprising a paper sheet feed roller adapted to be driven for rotation, and a press member disposed to oppose a cylindrical outer surface of said paper sheet feed roller along a generatrix thereof so as to define a nip region therebetween for nipping the paper sheet therein, wherein a friction coefficient between the outer surface of said paper sheet feed roller and a first surface of the paper sheet contacting therewith is higher than a friction coefficient between the first surface and a second surface opposite to the first surface of the paper sheet, and said press member is shiftable relative to said paper sheet feed roller so as thereby to change a mean friction coefficient between a band surface area thereof opposing said paper sheet feed roller in said nip region and the second surface of the paper sheet contacting therewith within a range lower than the friction coefficient between the outer surface of said paper sheet feed roller and the first surface of the paper sheet but higher than the friction coefficient between the first and second surfaces of the paper sheet; said press member being constructed to increase the mean friction coefficient between the band surface area thereof and the second surface of the paper sheet in said nip region as said press member is shifted relative to said paper sheet feed roller so that a more downstream band surface area thereof as viewed in a direction of the paper sheet transfer is brought to said nip region; said press member being an arc plate member having a convex surface of a friction characteristic which changes so that a mean friction characteristic of a portion of said outer surface opposing said paper sheet feed roller in said nip region increases as the arc plate press member is turned about a central axis of curvature of said convex surface of said convex surface in such a direction that said surface moves relative to said paper sheet feed roller in a direction opposite to a direction of transfer of the paper sheet.

2. A paper sheet transfer device according to claim 1, wherein said second portion occupies a generally triangular central region of the rectangular shape, while said first portion occupies two generally triangular regions on opposite sides of said second portion.

3. A paper sheet transfer device according to claim 1, wherein said convex surface, when viewed in a development to a plane rectangular shape defined by opposite lateral edges extending in parallel to the center axis of curvature of the arc plate press member and opposite longitudinal edges corresponding to opposite curved edges of the arc plate press member, includes a first portion and a second portion, said first portion having a higher friction characteristic than said second portion, the ratio of said first portion to said second portion along a line parallel to said lateral edges gradually increasing from one of said lateral edges toward the other of said lateral edges.

4. A paper sheet transfer device according to claim 3, wherein said first portion occupies a generally triangular central region of the rectangular shape, while said second portion occupies two generally triangular regions on opposite sides of said first portion.

5. A paper sheet transfer device according to claim 3, wherein said second portion occupies a generally triangular central region of the rectangular shape, while said first portion occupies two generally triangular regions on opposite sides of said second portion.

* * * * *